US010111489B2

(12) United States Patent
Thorne

(10) Patent No.: US 10,111,489 B2
(45) Date of Patent: Oct. 30, 2018

(54) SHOE INSERT ASSEMBLY

(71) Applicant: Maggie Thorne, Clearwater, FL (US)

(72) Inventor: Maggie Thorne, Clearwater, FL (US)

( * ) Notice: Subject to any disclaimer, the term of this patent is extended or adjusted under 35 U.S.C. 154(b) by 47 days.

(21) Appl. No.: 15/337,901

(22) Filed: Oct. 28, 2016

(65) Prior Publication Data

US 2018/0116331 A1 May 3, 2018

(51) Int. Cl.

| | |
|---|---|
| ***A43B 7/14*** | (2006.01) |
| ***A43B 17/00*** | (2006.01) |
| ***A43B 17/02*** | (2006.01) |
| ***A43B 17/18*** | (2006.01) |

(52) U.S. Cl.

CPC ..... *A43B 7/1445* (2013.01); *A43B 7/149* (2013.01); *A43B 17/006* (2013.01); *A43B 17/02* (2013.01); *A43B 17/18* (2013.01)

(58) Field of Classification Search

CPC ..... A43B 7/149; A43B 7/142; A43B 7/144; A43B 7/1465; A43B 7/1425; A43B 7/1485; A43B 17/02; A43B 17/18; A43B 17/006

USPC ..... 36/44, 80, 145, 155, 166, 174, 178, 180, 36/181

See application file for complete search history.

(56) References Cited

U.S. PATENT DOCUMENTS 1,475,055 A * 11/1923 Davis ..... A43B 7/1415 36/165
1,594,034 A * 7/1926 Anderson ..... A43B 7/142 36/159
2,088,511 A * 7/1937 Frei ..... A43B 7/142 36/159
2,404,731 A * 7/1946 Johnson ..... A43B 7/142 12/1 G
2,440,273 A * 4/1948 Hukill ..... A43B 7/14 36/141
2,637,122 A * 5/1953 Baer ..... A43B 21/32 36/173
2,662,309 A * 12/1953 Morton ..... A43B 7/142 36/165
2,736,109 A * 2/1956 Scholl ..... A43B 7/1455 36/44
2,909,854 A 10/1959 Edelstein
4,235,028 A * 11/1980 Riggs ..... A43B 21/32 36/69
4,316,333 A * 2/1982 Rothschild ..... A43B 7/142 36/50.1
4,336,661 A * 6/1982 Medrano ..... A43B 17/03 36/3 B
4,841,648 A * 6/1989 Shaffer ..... A43B 7/1465 36/145
4,862,604 A 9/1989 Hauser
6,000,147 A * 12/1999 Kellerman ..... A43B 7/142 36/160
D422,782 S 4/2000 Kress et al.
6,474,003 B2 11/2002 Erickson et al.
(Continued)

*Primary Examiner* — Ted Kavanaugh

(57) ABSTRACT

A shoe insert assembly includes a panel that is selectively positioned in a shoe. The panel has an opening therein and the opening is aligned with a heel when the shoe is worn thereby facilitating pressure to be relieved from the heel. A cushion is positioned within the panel and the cushion absorbs pressure exerted by a foot onto the shoe thereby enhancing comfort of the shoe. A pad is coupled to the panel and the pad is aligned with an arch in the foot when the shoe is worn thereby enhancing comfort of the shoe.

5 Claims, 4 Drawing Sheets

(56) References Cited

U.S. PATENT DOCUMENTS

| | | | |
|---|---|---|---|
| 6,990,756 | B1 | 1/2006 | Johnson |
| 7,249,425 | B2 | 7/2007 | Wang |
| 7,614,164 | B2 | 11/2009 | Morales et al. |
| 8,819,961 | B1 | 9/2014 | Ellis |
| 9,011,353 | B2 | 4/2015 | Hardman et al. |
| 2003/0110662 | A1 | 6/2003 | Gilman et al. |

* cited by examiner

SHOE INSERT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to insert devices and more particularly pertains to a new insert device for relieving pressure on a heel when a shoe is worn.

BRIEF SUMMARY OF THE INVENTION

An embodiment of the disclosure meets the needs presented above by generally comprising a panel that is selectively positioned in a shoe. The panel has an opening therein and the opening is aligned with a heel when the shoe is worn thereby facilitating pressure to be relieved from the heel. A cushion is positioned within the panel and the cushion absorbs pressure exerted by a foot onto the shoe thereby enhancing comfort of the shoe. A pad is coupled to the panel and the pad is aligned with an arch in the foot when the shoe is worn thereby enhancing comfort of the shoe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
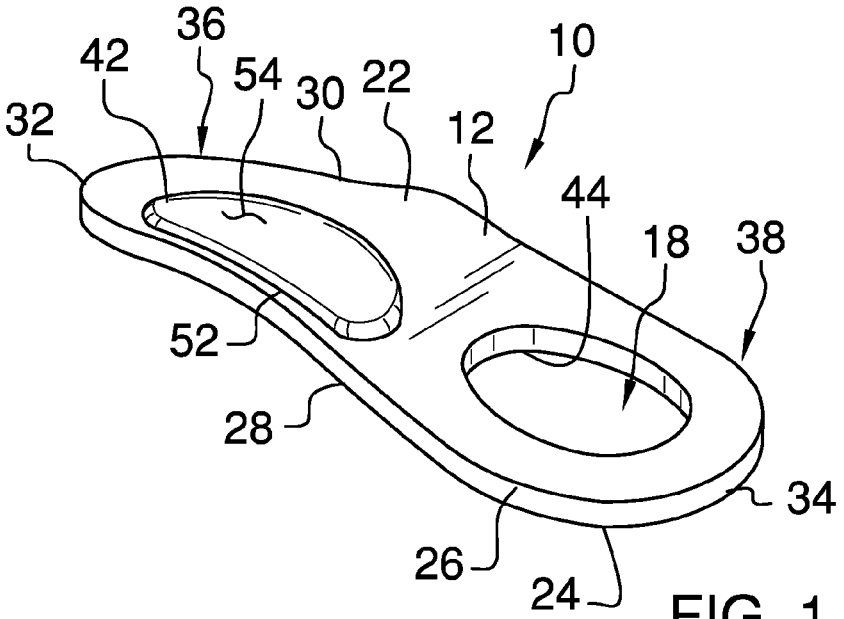
FIG. 1 is a top perspective view of a shoe insert assembly according to an embodiment of the disclosure.
Figure 2:
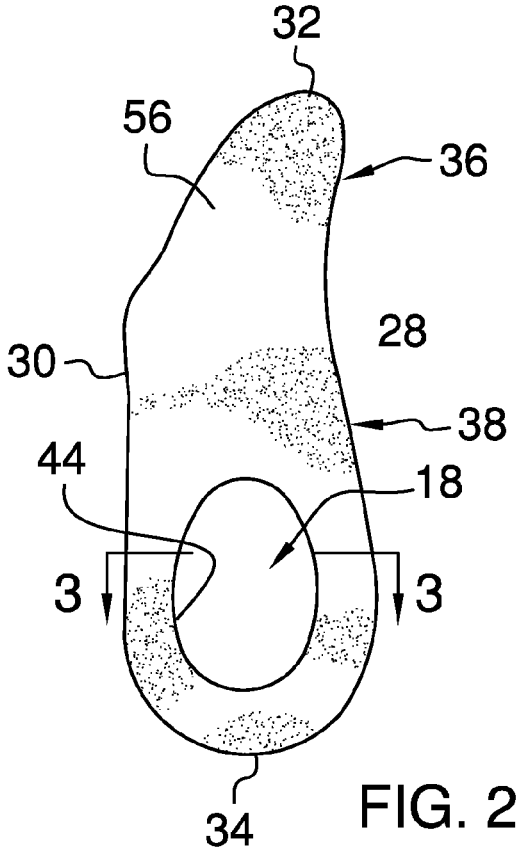
FIG. 2 is a bottom view of an embodiment of the disclosure.
Figure 3:
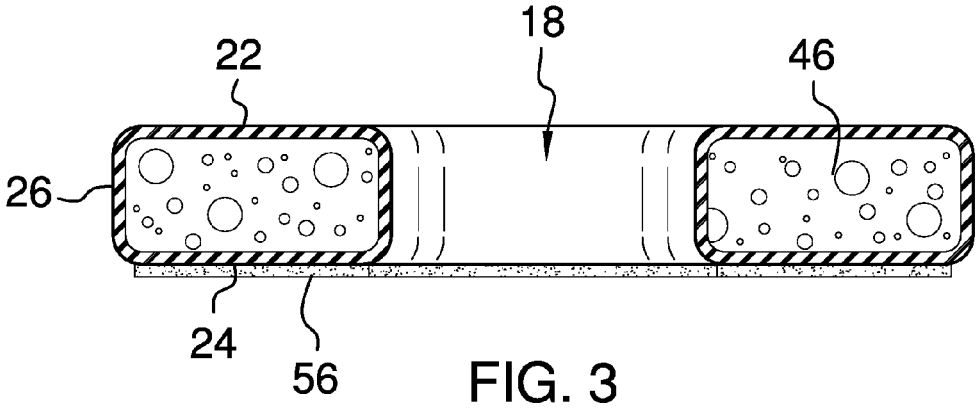
FIG. 3 is a cross sectional view taken along line 3-3 of FIG. 2 of an embodiment of the disclosure.

With reference now to the drawings, and in particular to FIGS. 1 through 7 thereof, a new insert device embodying the principles and concepts of an embodiment of the disclosure and generally designated by the reference numeral 10 will be described.

As best illustrated in FIGS. 1 through 7, the shoe insert assembly 10 generally comprises a panel 12 that may be positioned in a shoe 14. The shoe 14 may be a tennis shoe, a dress shoe or any other shoe 14 conventionally worn on a foot 16. The panel 12 has an opening 18 and the opening 18 is aligned with a heel 20 of the foot 16 when the shoe 14 is worn. The opening 18 relieves from the heel 20 when the shoe 14 is worn.

The panel 12 has a top wall 22, a bottom wall 24 and a peripheral edge 26 extending therebetween. The peripheral edge 26 has a first lateral side 28, a second lateral side 30, a front side 32 and a back side 34. The panel 12 is elongated between the front side 32 and the back side 34. The back side 34 is concavely arcuate between each of the first lateral side 28 and the second lateral side 30. The front side 32 is concavely arcuate between the first lateral side 28 and the second lateral side 30.

The first lateral side 28 curves outwardly with respect to a central axis extending through the front side 32 and the back side 34. The second lateral side 30 curves inwardly with respect to the central axis. Thus, a horn 36 is defined on the panel 12 that curves laterally away from a body 38 of the panel 12. The horn 36 is aligned with a ball 40 of the foot 16 when the shoe 14 is worn.

The bottom wall 24 abuts an insole 42 of the shoe 14 and a foot 16 is positioned on the top wall 22 when the shoe 14 is worn. The opening 18 is positioned closer to the back side 34 than the front side 32. The opening 18 has a bounding edge 44 and the bounding edge 44 is continuous such that the opening 18 has a substantially ovoid shape.

A cushion 46 is provided and the cushion 46 is positioned within the panel 12 to absorb pressure exerted by the foot 16 onto the shoe 14 thereby enhancing comfort of the shoe 14. The cushion 46 is positioned between the top wall 22 and the bottom wall 24. The cushion 46 may be comprised of a resiliently compressible material such as expanded foam or the like.

A pad 48 is coupled to the panel 12 and the pad 48 is aligned with an arch 50 in the foot 16 when the shoe 14 is worn thereby enhancing comfort of the shoe 14. The pad 48 has a first surface 52 and a second surface 54. The first surface 52 is coupled to the top wall 22 of the panel 12 and the pad 48 is aligned with the first lateral side 28 of the panel 12. The pad 48 is positioned between the opening 18 and the front side 32 of the panel 12. Additionally, the pad 48 may be comprised of a resiliently compressible material such as expanded foam or the like.

An adhesive layer 56 is coupled to the bottom wall 24 of the panel 12. The adhesive layer 56 adheres to the insole 42 of the shoe 14 thereby retaining the panel 12 on the insole 42. The adhesive layer 56 completely covers the bottom wall 24 of the panel 12.

Figure 4:
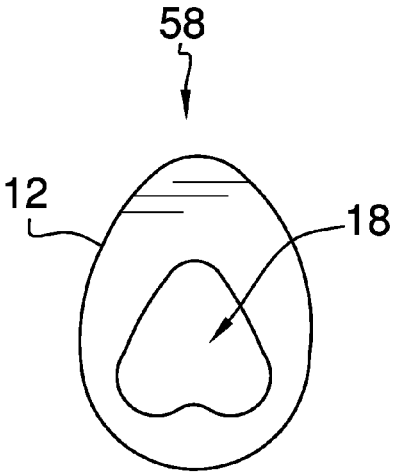
FIG. 4 is a top view of an alternative embodiment of the disclosure.
Figure 5:
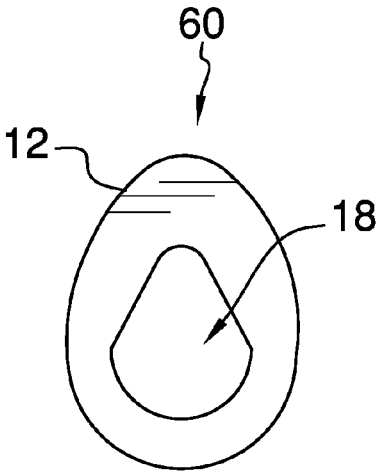
FIG. 5 is a top perspective view of an alternative embodiment of the disclosure.
Figure 6:
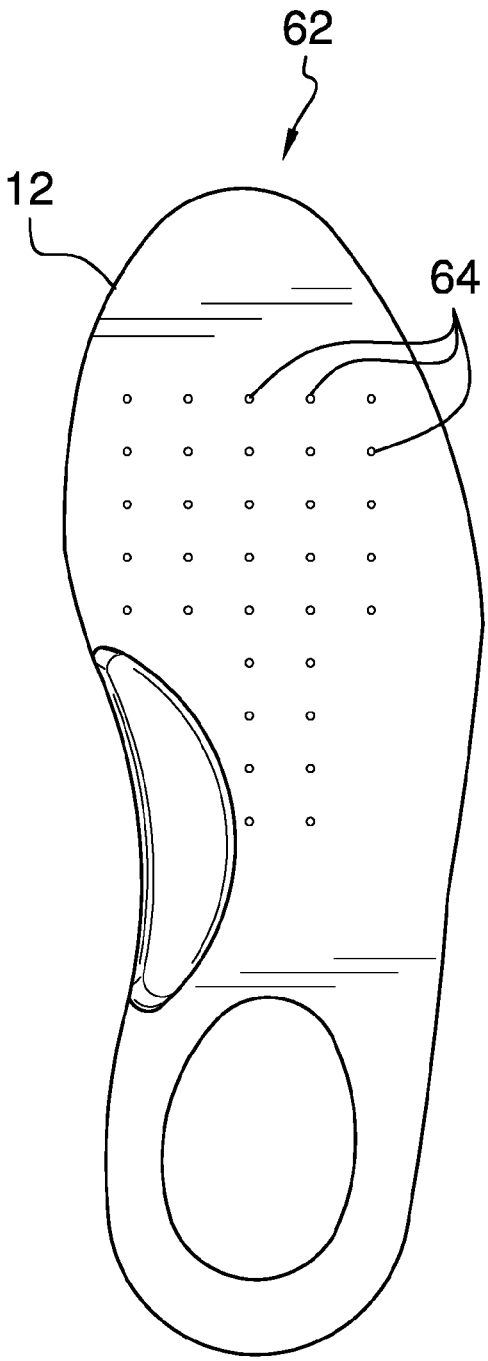
FIG. 6 is a top view of an alternative embodiment of the disclosure.
Figure 7:
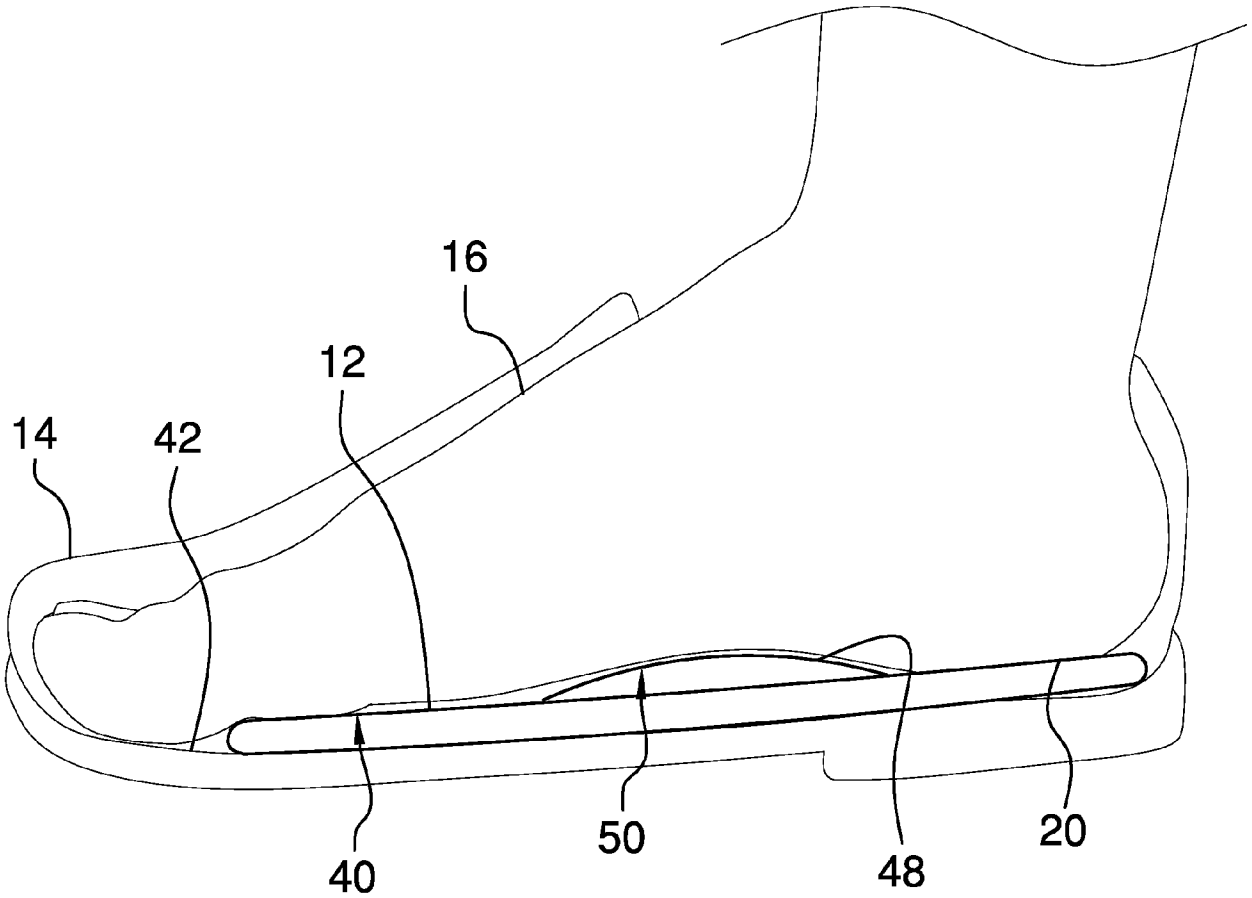
FIG. 7 is a perspective in-use view of an embodiment of the disclosure.

In an alternative embodiment 58 as shown in FIG. 4, the panel 12 may have a circular shape. The opening 18 may have a triangular shape. In an alternative embodiment 60 as shown in FIG. 5, the opening 18 may have a diamond shape. In an alternative embodiment 62 as shown in FIG. 5, the panel 12 may be shaped like the insole 42 of the shoe 14. The panel 12 may have plurality of perforations 64 extending therethrough to promote air flow between the foot 16 and the insole 42.

In use, the panel 12 is positioned on the insole 42 of the shoe 14 so the adhesive layer 56 adhesively engages the insole 42. The shoe 14 is worn and the heel 20 of the foot 16 is positioned in the opening 18. Thus, the heel 20 is inhibited from resting on the insole 42 thereby relieving pain in the heel 20 related to pressure on the heel 20. The pad 48 facilitates arch 50 support when the shoe 14 is worn and the cushion 46 cushions the foot 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe insert assembly being configured to support an arch of a foot thereby enhancing comfort of a shoe, said assembly comprising:

a panel being configured to be positioned in a shoe, said panel having an opening therein wherein said opening is configured to be aligned with a heel when the shoe is worn thereby facilitating pressure to be relieved from the heel said panel having a top wall, a bottom wall and a peripheral edge extending therebetween, said peripheral edge having a first lateral side, a second lateral side, a front side and a back side, said panel being elongated between said front side and said back side, said back side being concavely arcuate between each of said first lateral side and said second lateral side, said front side being concavely arcuate between said first lateral side and said second lateral side;

a cushion being positioned within said panel wherein said cushion is configured to absorb pressure exerted by a foot onto the shoe thereby enhancing comfort of the shoe;

a pad being coupled to said panel wherein said pad is configured to be aligned with an arch in the foot when the shoe is worn thereby enhancing comfort of the shoe, said pad having a first surface and a second surface, said first surface being coupled to said top wall of said panel, said pad being aligned with said first lateral side of said panel, said pad being positioned between said opening and said front side of said panel, said second surface being substantially planar and parallel to said top wall of said panel.

2. The assembly according to claim 1, wherein said first lateral side curves outwardly with respect to a central axis extending through said front side and said back side, said second lateral side curving inwardly with respect to said central axis, said bottom wall being configured to abut an insole of the shoe, said top wall being configured to have a foot positioned thereon when the shoe is worn.

3. The assembly according to claim 1, wherein said opening is positioned closer to said back side than said front side, said opening having a bounding edge, said bounding edge being continuous such that said opening has a substantially ovoid shape.

4. The assembly according to claim 1, further comprising an adhesive layer being coupled to said bottom wall of said panel wherein said adhesive layer is configured to adhere to the insole of the shoe thereby retaining said panel on the insole.

5. A shoe insert assembly being configured to support an arch of a foot thereby enhancing comfort of a shoe, said assembly comprising:

a panel being configured to be positioned in a shoe, said panel having an opening therein wherein said opening is configured to be aligned with a heel when the shoe is worn thereby facilitating pressure to be relieved from the heel, said panel having a top wall, a bottom wall and a peripheral edge extending therebetween, said peripheral edge having a first lateral side, a second lateral side, a front side and a back side, said panel being elongated between said front side and said back side, said back side being concavely arcuate between each of said first lateral side and said second lateral side, said front side being concavely arcuate between said first lateral side and said second lateral side, said first lateral side curving outwardly with respect to a central axis extending through said front side and said back side, said second lateral side curving inwardly with respect to said central axis, said bottom wall being configured to abut an insole of the shoe, said top wall being configured to have a foot positioned thereon when the shoe is worn, said opening being positioned closer to said back side than said front side, said opening having a bounding edge, said bounding edge being continuous such that said opening has a substantially ovoid shape;

a cushion being positioned within said panel wherein said cushion is configured to absorb pressure exerted by the foot onto the shoe thereby enhancing comfort of the shoe, said cushion being positioned between said top wall and said bottom wall;

a pad being coupled to said panel wherein said pad is configured to be aligned with an arch in the foot when the shoe is worn thereby enhancing comfort of the shoe, said pad having a first surface and a second surface, said first surface being coupled to said top wall of said panel, said second surface being substantially planar and parallel to said top wall of said panel, said pad being aligned with said first lateral side of said panel, said pad being positioned between said opening and said front side of said panel; and an adhesive layer being coupled to said bottom wall of said panel wherein said adhesive layer is configured to adhere to the insole of the shoe thereby retaining said panel on the insole.

* * * * *